United States Patent [19]

Cousino

[11] Patent Number: 4,726,156

[45] Date of Patent: Feb. 23, 1988

[54] SKYLIGHT SHUTTER

[76] Inventor: Ronald T. Cousino, 9741 Dixie Hwy., Box 57, Erie, Mich. 48133

[21] Appl. No.: 934,345

[22] Filed: Nov. 24, 1986

[51] Int. Cl.[4] ..... E04B 65/04; E04D 13/035

[52] U.S. Cl. ..... 52/72; 49/63; 52/200

[58] Field of Search ..... 52/72, 200; 49/63, 372, 49/377

[56] References Cited

U.S. PATENT DOCUMENTS

| | | | |
|---|---|---|---|
| 4,385,470 | 5/1983 | Bryson | 49/63 |
| 4,434,579 | 3/1984 | Murphy | 49/63 |
| 4,443,978 | 4/1984 | Butler | 49/63 |

FOREIGN PATENT DOCUMENTS

| | | | |
|---|---|---|---|
| 2213646 | 10/1973 | Fed. Rep. of Germany | 52/72 |

*Primary Examiner*—John E. Murtagh

*Attorney, Agent, or Firm*—MacMillan, Sobanski & Todd

[57] ABSTRACT

A skylight shutter mechanism includes a box which preserves the structural vapor barrier and houses a moveable shutter which extends into and closes a light well of an associated skylight. The skylight shutter mechanism is provided for installation between rafters or ceiling joists of the ceiling containing the skylight. The shutter mechanism is preferably installed in new construction before walls and ceilings are finished. The shutter is manually moveable along cooperating rails by an actuating cord having ends which can be located remote from the skylight. To accommodate inclined mounting surfaces, a mechanism is provided for maintaining the shutter in a selected position. The shutter may be opaque and insulating or translucent. Also the operation of the shutter may be conveniently motorized.

4 Claims, 5 Drawing Figures

SKYLIGHT SHUTTER

BACKGROUND OF THE INVENTION

The present invention relates in general to the field of skylight structures and, in particular, to a shutter assembly for a skylight which is located on the interior side of the skylight.

Skylight are becoming increasingly popular, both in residential and commercial buildings. A skylight is desirable from an aesthetic standpoint in that it permits the substitution of daylight for electric light in a building. This results in lowered usage of electrical lighting, as well as providing a more natural color balance in interior lighting.

One problem associated with skylights is that, due to its ceiling-mounted location, it is generally not convenient to control the light coming through the skylight by means of curtains and draperies and the like. While it has been proposed to mount venetian-type blinds below a skylight across a light well to control the amount of light entering a room through the skylight, these blinds are often difficult to mount and operate.

Another problem associated with skylights is that typically a skylight has a lower insulating value than the surrounding ceiling structure. Consequently, it is desirable, at least in colder climates, to cover the skylight to reduce structural heating required in cold weather. It has been proposed to utilize insulating boxes which are placed over the skylight on the exterior of the skylight during cold weather. Also, it has been proposed to utilize transparent plastic films which are attached with adhesive tape to cover the light well during cold weather. However, these impromptu insulating provisions are not practical when either the exterior roof of the building slants at a steep angle, or the interior ceiling is at a great elevation, as with cathedral-type ceilings.

SUMMARY OF THE INVENTION

The present invention relates to a unique skylight shutter assembly which can be utilized to close off a skylight opening to either retain heat, reduce heat gain, or regulate the light from the skylight.

In particular, the shutter structure of the present invention includes a box member which is inset in the side of a light wall of a skylight and has an open end facing the light well. A shutter member is selectively movable between a retracted position wherein the shutter member is contained in the box member, and an extended position wherein the shutter member extends from the box member across the light wall to occlude the light well. The shutter member can be provided with an insulating foam core.

In accordance with the present invention, the box member includes means for resisting the passage of vapor from the interior of the building through the open end of the box and into the space between the box member and a roof of the building.

In the preferred embodiment of the invention, the shutter member is moved between the retracted and extended positions by a cable means. While in the disclosed embodiment the shutter is moved by manually pulling the ends of the cables, the shutter can be easily motorized in a conventional fashion. In instances wherein the skylight shutter is to be mounted in a steeply angled ceiling, the present invention provides a unique holding cam mechanism to enable the shutter member to be locked in a selected position.

The skylight shutter of the present invention includes peripheral seal means surrounding the shutter member for sealingly contacting adjacent side wall portions of the light well when the shutter member is in the extended position. The shutter member and the peripheral seal means cooperate with the light well and the skylight to define an enclosed dead air space in the light well between the skylight and the shutter member.

In the preferred embodiment of the invention, the shutter member is movable between the retracted and extended positions upon first runner members affixed to the interior side walls of the box member and upon second runner members affixed to side walls of the light well and generally colinear with the first runner members. The shutter member defines front, side and rear marginal edge portions, and the second runners sealing by contact the side marginal edge portions when the shutter is in the extended position. Further, front seal means are provided for sealing the front marginal edge of the shutter relative to an adjacent side wall portion of the light well, and rear seal means are provided for sealing the rear marginal edge of the shutter relative to an adjacent side wall portion of the light well. The shutter member, the front seal means, the rear seal means, and the second runner members cooperate to inpart define an enclosed air space in the light well between the skylight and the shutter member when the shutter member is in the extended position.

Preferably, the shutter assembly of the present invention is installed during the initial construction of a building before the ceiling and wall panels are installed.

The above, as well as other advantages and features of the present invention, will become readily apparent to one skilled in the art from reading the following detailed description of the preferred embodiment of the invention in conjunction with the attached drawings.

DESCRIPTION OF THE PREFERRED EMBODIMENT

Figures 1, 3, 4:
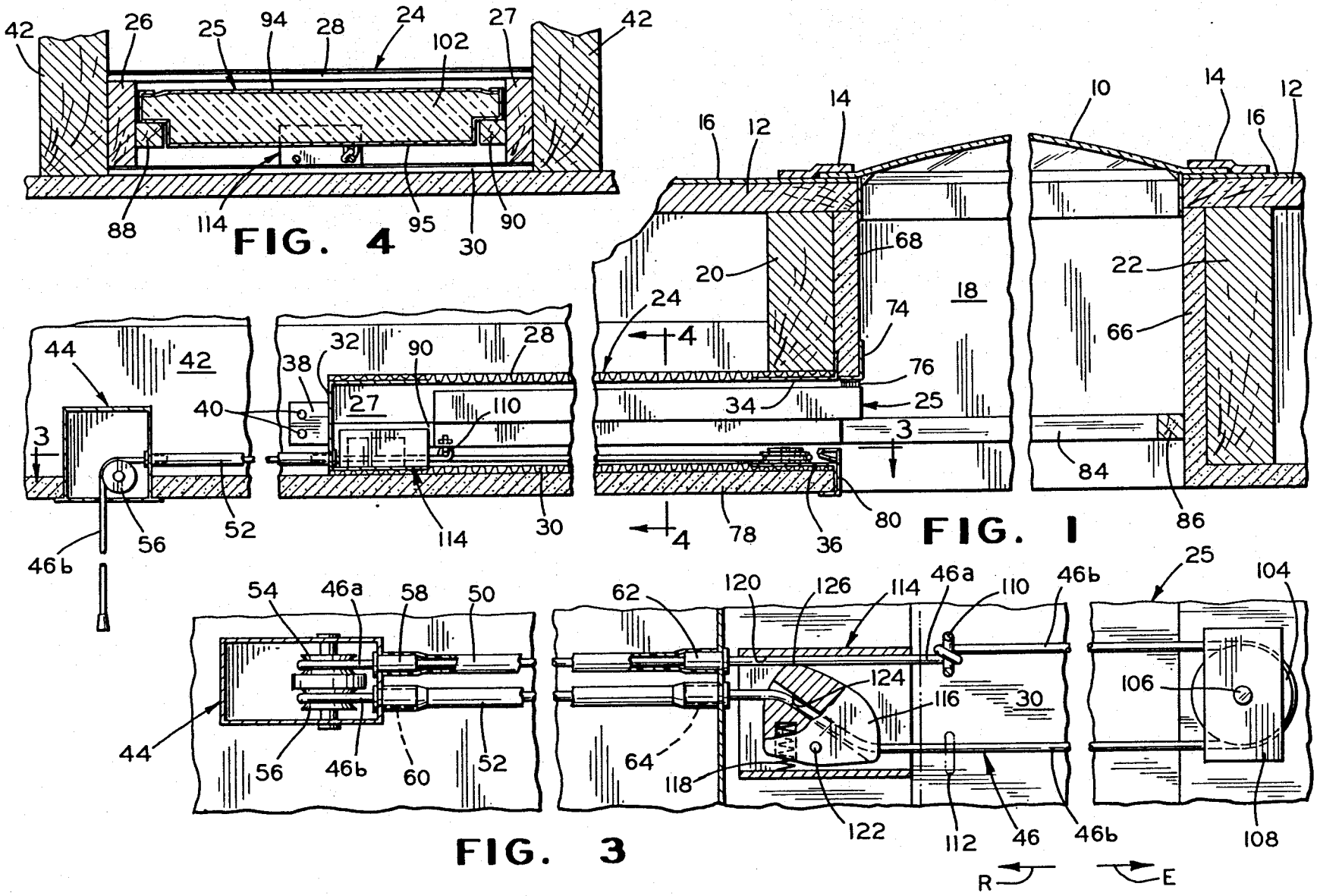
FIG. 1 is a side sectional view of the skylight shutter assembly of the invention installed adjacent a skylight, and shown in its retracted or open position.
FIG. 3 is top sectional view taken along line 3—3 in FIG. 1 and showing the pulley mechanism and the holding mechanism which is utilized to move the shutter and maintain the shutter in a selected position.
FIG. 4 is a sectional view taken along line 4—4 in FIG. 1.

Preliminarily, it should be noted that the building structure which surrounds and supports the skylight shutter of the present invention is schematically illustrated in the drawings in a typical installation. The drawings herein are not intended as a precise and detailed representation of the structure of either a cathedral roof or a level ceiling.

Figure 2:
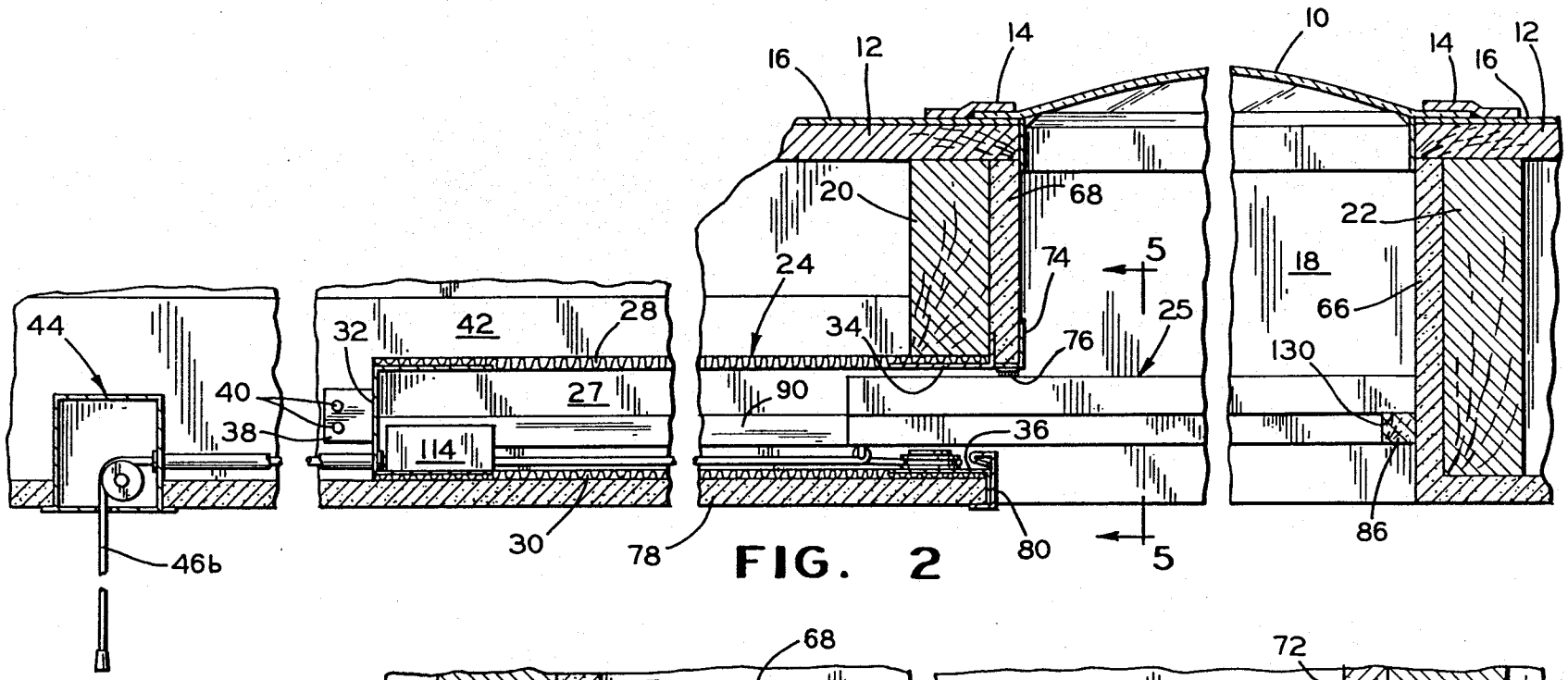
FIG. 2 is a side sectional view of the invention, similar to FIG. 1, but showing the shutter in its extended or closed potition.

Turning first to FIGS. 1 and 2, it may be seen that a conventional skylight 10 is mounted over an opening provided in the roof boards 12 and is sealed around its edges by a flashing 14 sealingly attached to shingles 16.

The opening below the skylight 10 defines a light well area 18 which is framed in a conventional manner with framing boards such as the framing boards 20 and 22.

Preferably, the skylight shutter assembly of the present invention is installed during the construction of the building, after the installation of the main framing members and prior to installing and finishing the associated dry wall. In the preferred embodiment of the invention, a shutter box 24 has an open end which is located at the bottom of the light well area 18 for receiving a slidable shutter 25 when it is in its retracted position, as shown in FIG. 1. The box 24 has side panels 26 and 27 (shown in FIG. 4) made of wood treated with a suitable vapor barrier material, and top and bottom panels 28 and 30 fabricated of corrugated cardboard which has been made rigid and vapor proof such as by treating with a wax. A U-shaped rear housing member 32 extends along the rear of the box. The member 32 is fabricated of sheet metal and is suitably secured to the rear edge portions of the side panels 26 and 27 and the top and bottom panels 28 and 30. Upper and lower front lip members 34 and 36, which can be fabricated from sheet metal, are secured along the front edge portions of the top and bottom panels 28 and 30 respectively and also fabricated from sheet metal.

In addition, the corners of the box 24 can be provided with sheet metal tabs for nailing to ceiling joists and the like. The box 24 is preferably provided with four such tabs, one at each corner, and which can be provided with the apertures for nailing. As illustrated in FIGS. 1 and 2, only one tab 38 having apertures 40 is visible. At this point in construction, the tabs 38 are fastened by nailing such as to ceiling joists or rafters 42 and to appropriate framing boards (not shown). The upper front lip member 34 is fastened to the lower edge of the framing board 20, preferably by nailing.

A sheet metal pulley box 44 is fastened in any appropriate manner at a convenient distance from the box 24. Although no mounting provisions are illustrated, it will be apparent that, for instance, the known ways of fastening an electrical fixture box are equally applicable to the fastening of the box 44. It should be noted that while the details of the preferred embodiment of the invention described herein concern a manually operated version, the invention may be fitted with an electric motor in any convenient manner as is well known in the art.

As shown in FIG. 3, an operating cable or cord 46 having end portions **46*a* and 46*b* passes through plastic tubes 50 and 52 and over the pulleys 54 and 56 in the pulley box 44. The one ends of the plastic tubes 50 and 52 are pressed over flared sleeves 58 and 60 which extend from a side wall of the box 44. The opposite ends of the plastic tubes 50 and 52 are pressed on the flared sleeves 62 and 64 extending from the U-shaped rear housing member 32. Thus, the vapor barrier between the room associated with the light well 18 and insulation (not shown) which may be provided between and above the rafters and ceiling joists 42** is maintained.

Figure 5:
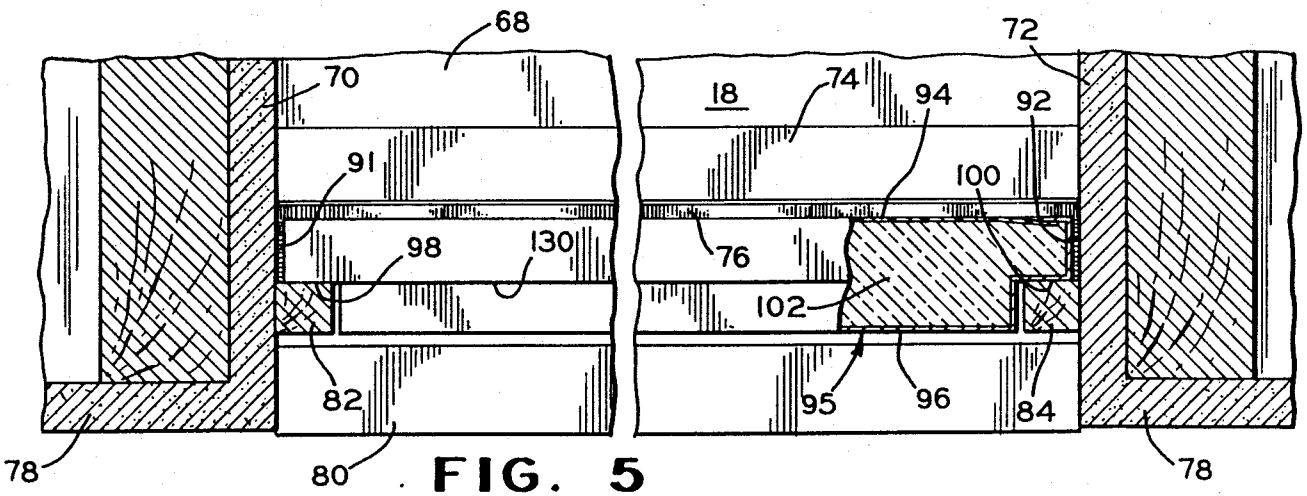
FIG. 5 is a sectional view taken along the line 5—5 in FIG. 2.

After the above described portion of the installation has been completed, the walls, ceiling and light well are finished in conventional manner such as with dry wall board. The light well 18 is finished with the dry wall panel 66 opposite the opening of the box 24 and with the dry wall panel 68 adjacent the opening, and also with panels 70 and 72, as best shown in FIG. 5. An upper front lip cover 74 is installed on the lowermost surface of the dry wall panel 68 and is provided with sealing means 76 in the form of a fabric pile. Ceiling dry wall panels 78 are then installed, and a lower lip cover member 80 is fastened over the end surface of the panel 78 adjacent the opening of the box 24. Then, longitudinal runner or rail members 82 and 84 are installed along the dry wall panels 70 and 72 in the light well 18. A cross rail member 86 is fastened to the dry wall panel 66 and connects the outer ends of the runners 82 and 84. As may be seen, the rails or runners 82 and 84 are effective continuations of rails or runner members 88 and 90 (shown in FIG. 4) which are fastened to the interior surfaces of the side panels 26 and 27 of the box 24. In some instances, it may be desirable to provide fabric pile seal means at areas 91 and 92, which are shown in FIG. 5 along the dry wall panels 70 and 72 between the runners 82 and 84 and the outer edges of the sealing means 76.

In the preferred embodiment of the invention, the shutter 25 is a three-part assembly. As shown in FIG. 5, the shutter 25 has an uppermost panel 94 typically formed of a plastic sheet material, and an integrally formed lower aluminum portion 95 defining a lower surface 96 and stepped side surfaces 98 and 100 to enable the shutter 25 to slide upon the cooperating side rails 82, 84, 88, and 90. The shutter also includes an appropriately-shaped core 102 typically formed of insulating foam. It will be appreciated that the upper panel 94 and the lower portion 95 may also be formed of a translucent or transparent plastic, and the core 102 can either be eliminated or can be a transparent or translucent plastic formed into a honeycomb configuration for rigidity.

In FIG. 3, the cable operating mechanism of the preferred embodiment of the invention is illustrated in detail. As shown, a pulley 104 is fastened to the lower front lip member 36 by a pivot pin 106, and is provided with a keeper 108 for maintaining the cord 46 on the pulley 104. The inner ends of the cord portions **46*a* and 46*b* meet and are attached to the shutter 25 by a U-bolt 110 secured to the lower surface 95 of the shutter. It should be noted that this arrangement is appropriate for a level-ceiling installation, or where the shutter 25 moves downwards as it extends from the box 24. However, if the shutter 25 is mounted to move upwards during its extension, the cord 46 would be attached to a U-bolt at position 112 (shown in phantom in FIG. 3**) as an alternative.

The cord 46 passes through a cam holding mechanism 114. A pivotally mounted cam 116 is urged by a spring 118 against the cord portion **46*a*, urging it against a wall 120 of the holding mechanism 114. This maintains the shutter 25 in position at least against forces which would urge it towards the right as illustrated in FIG. 3, since a force in this direction on the cord portion 46*a* would increase the wedging action between the cam 116 and the wall 120. The cam 116 is mounted on a pivot pin 122 and the cord portion 46*b* is passed through an aperture 124 in the cam 116, which is positioned so as to form an offset in the cord portion 46*b*. A portion 126 of the cam 116 which contacts the cord 46** may be provided with serrations or the like to improve its holding power. The serrations may be in the form of one or more grooves which match the spacing of the exterior configuration of the cord used.

When it is desired to extend the shutter 25 in the direction E, the free end of the cord portion **46*b* is pulled to apply a tension to the cord portion 46*b*. As tension is applied to the cord portion 46*b*, the cord portion 46*b* will tend to assume a straighter configuration which causes the cam 116 to rotate about the pivot point 122 against the force of spring 118, thus releasing the clamping force on the cord portion 46a and enabling the shutter 25 to be extended in the direction E. When it is desired to retract the shutter in the direction R, the free end of the cord portion 46a is pulled, causing the cam 116 to pivot slightly and release its grip on the cord portion 46a**, thus enabling the shutter to be pulled in the direction R.

Turning now to FIG. 2, it may be seen that the lower portion 95 of the shutter 25 panel 92 is further provided with a stepped front end surface 130 which cooperates with the cross rail 86 to block air circulation between the shutter panel 92 and the dry wall panel 66, as well as to support the front portion of the shutter panel 25. Alternatively, the cross rail 86 may be eliminated, and a fabric pile sealing strip can be located along the front edge of the shutter 25 for sealing engagement with the dry wall panel 66. As previously mentioned, the side marginal edges of the shutter 25 are sealed by the cooperation of the stepped surface 98 and 100 and the side rails 82 and 84 (shown in FIG. 5), while the rear marginal edge of the shutter 25 is effectively sealed by the fabric pile sealing strip 76. Thus, when the shutter 25 is in the extended or closed position shown in FIG. 1, the area in the light well 18 above the shutter 25 is effectively sealed from the room below, creating a dead air space which further adds to the insulating properties of the present invention.

The principle and mode of operation of the invention have been illustrated in what is considered to represent its present preferred embodiment. However, it will be appreciated that the invention can be readily be modified to accommodate various types of building structures, and that the specific structure of the movable insulated skylight shutter described herein, as well as the specific materials used in its construction, can be modified without departing from the scope of the attached claims.

What is claimed is:

1. A skylight structure comprising:

a skylight mounted in an upper end of a light well;

a box means inset in the side of said light well of said skylight and having an open end facing said light well, said box means being substantially air tight except for said open end;

a shutter movable between a retracted position wherein said shutter is contained in said box means to an extended position wherein said shutter extends from said box means across said light well to occlude said light well;

said shutter defining front, side and rear marginal edge portions;

said shutter being adapted to move between said retracted and extended positions upon first runners affixed to interior side walls of said box means and upon second runners affixed to side walls of said light well and generally colinear with said first runners, said second runners sealingly contacting said side marginal edge portions of said shutter when said shutter is in said extended position;

front seal means for sealing said front marginal edge of said shutter relative to an adjacent first side wall portion of said light well when said shutter is in said extended position;

rear seal means for sealing said rear marginal edge of said shutter relative to an adjacent second side wall portion of said light well when said shutter is in said extended position;

said shutter, said front seal means, said rear seal means, and said second runners cooperating in part to define an enclosed dead air space in said light well between said skylight and said shutter when said shutter is in said extended position;

cable means located within said box means and operatively connected to said shutter; and means for operating said cable means for moving said shutter between said retracted and extended positions.

2. The skylight structure according to claim 1 wherein said shutter includes an insulating core.

3. A skylight structure comprising:

a skylight mounted in an upper end of a light well;

a first box means inset in the side of said light well of said skylight and having an open end facing said light well, said first box means being substantially air tight except for said open end;

a shutter movable between a retracted position wherein said shutter is contained in said first box means to an extended position wherein said shutter extends from said first box means across said light well to occlude said light well;

said shutter defining front, side and rear marginal edge portions;

said shutter being adapted to move between said retracted and extended positions upon first runners affixed to interior side walls of said first box means and upon second runners affixed to side walls of said light well and generally colinear with said first runners, said second runners sealingly contacting said side marginal edge portions of said shutter when said shutter is in said extended position;

front seal means for sealing said front marginal edge of said shutter relative to an adjacent first side wall portion of said light well when said shutter is in said extended position;

rear seal means for sealing said rear marginal edge of said shutter relative to an adjacent second side wall portion of said light well when said shutter is in said extended position;

said shutter, said front seal means, said rear seal means, and said second runners cooperating in part to define an enclosed dead air space in said light well between said skylight and said shutter when said shutter is in said extended position;

a second box means spaced from said first box means;

tube means connecting said first and second box means;

cable means located within said first box means and operatively connected to said shutter, said cable means extending through said tube means and into said second box means; and said cable means extending from said second box means and operable for moving said shutter means between said retracted and extended positions.

4. A skylight structure comprising:

a skylight mounted in an upper end of a light well;

an inclined box means inset in the side of said light well of said skylight and having an open end facing said light well in a generally downwardly inclined direction, said box means being substantially air tight except for said open end;

an inclined shutter movable between a retracted position wherein said shutter is contained in said box means to an extended position wherein said shutter means extends from said box means across said light well to occlude said light well;

said shutter defining front, side and rear marginal edge portions;

said shutter being adapted to move along an inclined path between said retracted and extended positions upon first inclined runners affixed to interior side walls of said box means and upon second inclined runners affixed to side walls of said light well and generally colinear with said first runners, said second runners sealingly contacting said side marginal edge poritons of said shutter when said shutter is in said extended position;

front seal means for sealing said front marginal edge of said shutter relative to an adjacent first side wall portion of said light well when said shutter is in said extended position;

rear seal means for sealing said rear marginal edge of said shutter relative to an adjacent second side wall portion of said light well when said shutter is in said extended position;

said shutter, said front seal means, said rear seal means, and said second runners cooperating in part to define an enclosed dead air space in said light well between said skylight and said shutter when said shutter is in said extended position;

cable means located within said box means and operatively connected to said shutter;

means for operating said cable means for moving said shutter between said retracted and extended positions; and means for locking said cable means to maintain said shutter in a selected inclined position along said first and second inclined runners.

* * * * *